United States Patent [19]

Roesler

[11] Patent Number: 4,871,303

[45] Date of Patent: Oct. 3, 1989

[54] FUEL DRAIN SAFETY SYSTEM FOR FUEL PUMPS AND THE LIKE

[75] Inventor: Carl A. Roesler, Rockford, Ill.

[73] Assignee: Sundstrand Corporation, Rockford, Ill.

[21] Appl. No.: 226,744

[22] Filed: Aug. 1, 1988

[51] Int. Cl.[4] ..... F04B 21/00

[52] U.S. Cl. ..... 417/434; 417/360; 417/423.1; 417/433.14; 417/313; 415/201

[58] Field of Search ..... 417/434, 360, 423.1, 417/433.14, 313, 410; 415/201, 121 R, 127, DIG. 3; 285/81, 358, 359, 360, 361, 394, 395, 396, 314

[56] References Cited

U.S. PATENT DOCUMENTS

| | | | |
|---|---|---|---|
| 4,318,667 | 3/1982 | Miller | 417/360 |
| 4,324,532 | 4/1982 | Knife | 417/360 |
| 4,781,527 | 11/1988 | Miller | 417/361 |

*Primary Examiner*—Carlton R. Croyle
*Assistant Examiner*—Robert N. Blackman
*Attorney, Agent, or Firm*—Wood, Dalton, Phillips Mason & Rowe

[57] ABSTRACT

A fuel drain system for use in a fuel pump for an aircraft fuel tank or the like which includes a housing and a pump cartridge positionable in the housing for removal therefrom. A drain plug is removably mounted on and projects from the pump cartridge for draining residual fuel from the cartridge prior to removal of the cartridge from the housing. A stop is located in a path of movement of the projecting drain plug to prevent removal of the pump cartridge from the housing unless the drain plug is removed from the pump cartridge. This provides for verification that the main inlet closure to the fuel pump has been closed and, thus, prevents massive fuel leakage.

17 Claims, 2 Drawing Sheets

FIG. 2
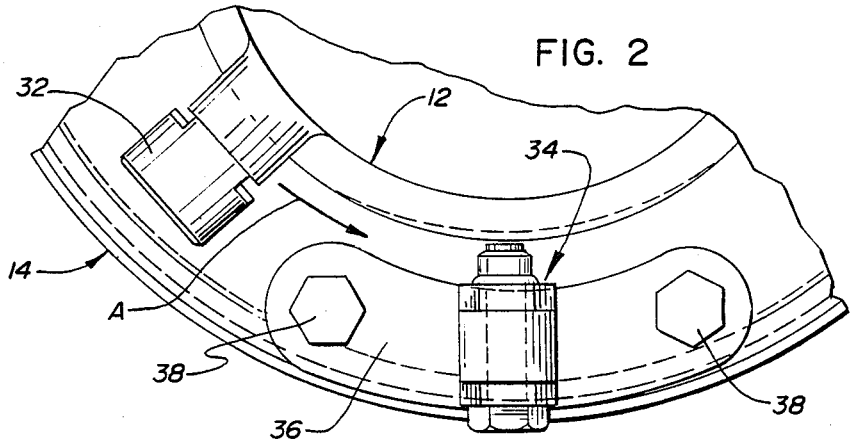
FIG. 4
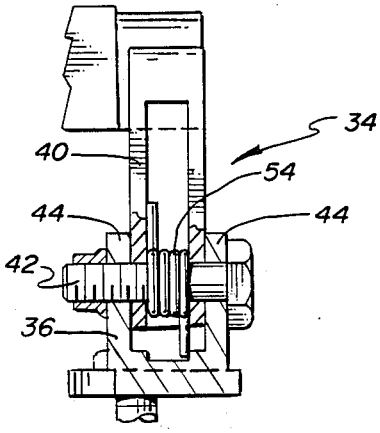
FIG. 3
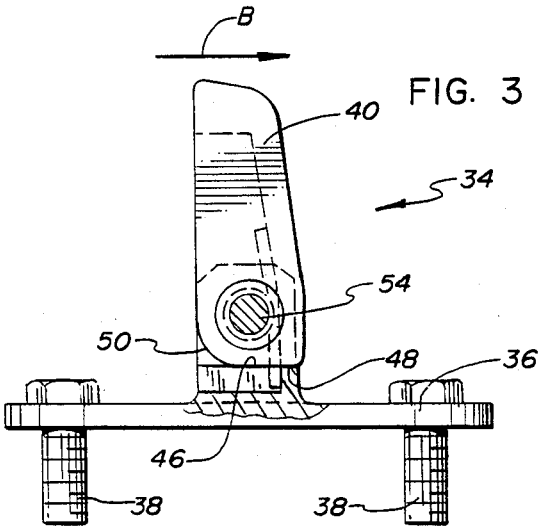
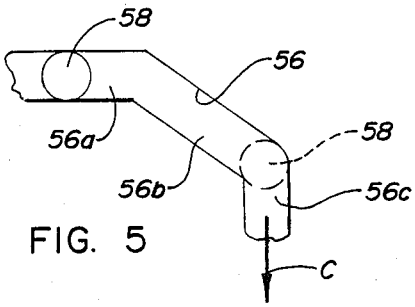
FIG. 5
FIG. 6
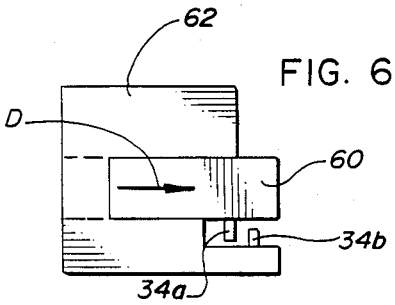

FUEL DRAIN SAFETY SYSTEM FOR FUEL PUMPS AND THE LIKE

FIELD OF THE INVENTION

This invention generally relates to fluid pumps and, particularly, to a drain system which prevents removal of a pump cartridge unless a drain means is removed from the cartridge prior to removal.

BACKGROUND OF THE INVENTION

Cartridge or plug-in pumps often are employed in those environments where the pump is housed within the confines of a tank or receptacle containing fluid to be delivered under pressure remote from the tank or receptacle. These cartridge or plug-in pumps, as they are frequently called, are so designed as to permit their ready removal from the tank or receptacle for replacement or repair. The pumps may be primary sources of fluid under pressure, or they may function as boost pumps to deliver the fluid from the tank or receptacle to another pump for final delivery to a system and use.

For example, in an aircraft environment, pumps of the character described typically are located on the bottom surface or the side wall of the fuel tanks to allow external access to the pump cartridge.

The fuel tanks may be at varying levels of fullness and the removal of the pump must be effected without the requirement of draining the fuel tank. Therefore, many such systems have valve constructions which are somehow operatively associated with the pump cartridge whereby removal of the pump cartridge automatically closes the valve to seal off the fuel tank from the pump housing and allow pump removal without massive fuel leakage. An example of such a system is shown in copending application Ser. No. 198,744, filed May 25, 1988, which is assigned to the assignee of this invention.

Still, with the above-described precautionary measures, a problem exists in verifying that the automatic shut-off valve actually has sealed the fuel tank before removing the pump cartridge. In other words, should the valve malfunction for some reason, removal of the pump cartridge would allow massive leakage from the fuel tank.

In U.S. Pat. No. 4,318,667 to Miller, dated Mar. 9, 1982 and assigned to the assignee of this invention, a pump inlet closure valve/actuating mechanism assures that the valve is closed prior to pump removal. It also effectively blocks removal of a drain plug prior to inlet closure valve actuation. However, the mechanism of Miller does not require that the drain plug be removed before the pump cartridge can be removed. Thus, there is no effective verification of inlet closure valve sealing prior to pump withdrawal.

This invention is directed to an improved system which employs a simple mechanism to allow valve closure, but prevents pump removal or withdrawal unless a drain plug on the pump cartridge has been removed, thus verifying an effective inlet closure valve seal. In essence, the invention uses a drain means on the pump cartridge to prevent removal of the cartridge from the pump housing unless the drain means is removed from the pump cartridge itself. In this manner, absolute verification of inlet closure is effected before the pump cartridge can be withdrawn.

SUMMARY OF THE INVENTION

An object, therefore, of the invention is to provide a new and improved fuel drain system in a fuel pump, such as for an aircraft fuel tank or the like, which prevents removal of a pump cartridge from a pump housing unless the drain means is removed from the pump cartridge. This simple system provides accurate verification of tank sealing before pump removal.

In the exemplary embodiment of the invention, a pump cartridge is positionable in a pump housing for removal therefrom. Drain means in the form of a drain plug is removably mounted on and projects from the pump cartridge for draining residual fuel from the pump cartridge prior to removal of the cartridge from the housing. Stop means are located in the path of movement of the projecting drain plug to prevent removal of the pump cartridge from the housing unless the drain plug is removed from the pump cartridge.

The pump cartridge may be removable from the pump housing either rotatably or axially as long as the stop means is located in the path of movement of the projecting drain plug. For instance, in a rotatably removable pump cartridge, the stop means is located on the housing angularly disposed in the path of rotational movement of the drain plug during rotatable movement of the pump cartridge from the housing.

Generally, the stop means include means for blocking the drain plug in a first, removal direction of the pump cartridge but for allowing passage of the drain plug in a second, installation direction of the pump cartridge.

This is provided in the preferred embodiment by constructing the stop means in the form of a "one-way" spring loaded arm pivotally mounted and projecting from the pump housing for pivotal movement between a first, blocking position and a second, unblocking position. The spring biases the arm to its blocking position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 2 is a fragmented elevational view looking generally in the direction of line 2—2 of FIG. 1;

FIG. 3 is an isolated bottom plan view of the stop means, as viewed upwardly from the bottom of FIG. 2;

FIG. 4 is an elevational view looking to the left-hand side of FIG. 3;

FIG. 5 is a somewhat schematic illustration of a cam slot for effecting removal of the pump cartridge from the pump housing; and FIG. 6 is a schematic, block illustration of the concepts of the invention utilized in an axially removable pump.

DETAILED DESCRIPTION OF THE PREFERRED EMBODIMENT

Figure 1:
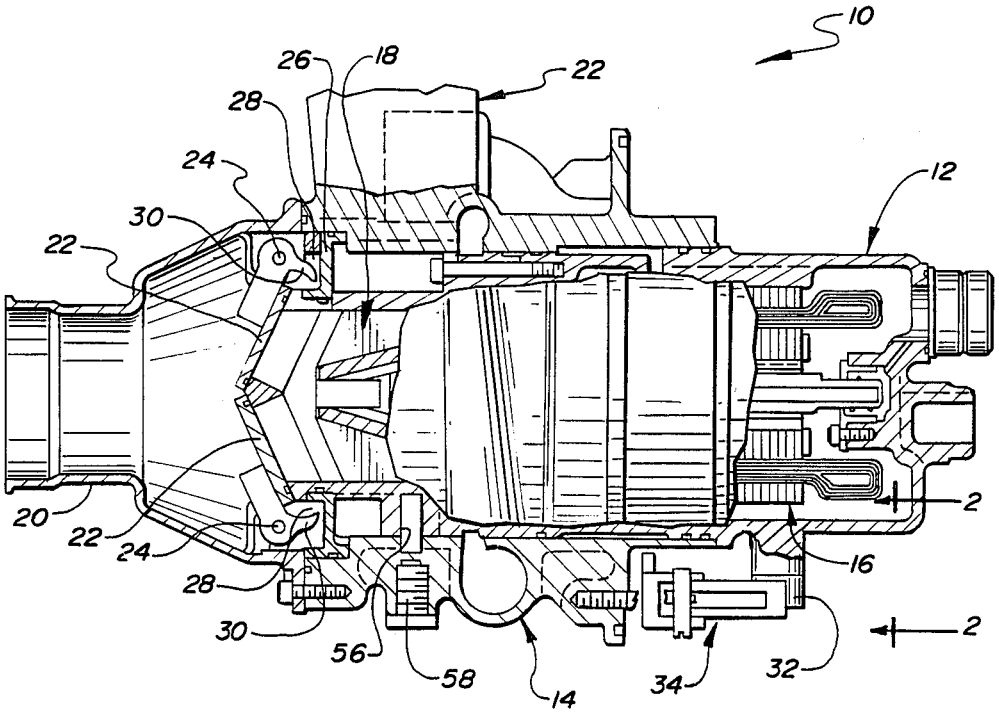
FIG. 1 is an axial section through a cartridge-type pump embodying the novel fuel drain system of the invention.

Referring to the drawings in greater detail, and first to FIG. 1, the invention is shown herein as embodied in a main boost pump, generally designated 10, of an aircraft fuel system. The boost pump includes a pump cartridge, generally designated 12, positionable in a housing, generally designated 14, for removal therefrom. It immediately should be understood that this particular pump is but for illustration purposes and all of its details will not be described because they are well within the purview of one skilled in this art.

Suffice it to say, pump cartridge 12 has a motor, generally designated 16, for rotating an impeller, generally designated 18. Housing 14 has an inlet 20 which is connected to a fuel tank, and impeller 18 is effective to pump fuel from the tank (not shown), through inlet 20 and into a manifold, generally designated 22, for its intended purpose.

Inlet 20 is opened and closed by a pair of flap valves 22 pivotally mounted at 24 for opening and closing. When pump cartridge 12 is fully installed, flap valves 22 are opened to expose the pump to inlet 20. The flap valves are shown closed simply to facilitate the illustration. As with many such systems, the valves are opened and closed automatically in response to installation and removal of the pump cartridge. To this end, the pump cartridge is operatively associated with a cam ring 26 having cam slots 28 into which cam follower arms 30 project. The cam follower arms are integral with flap valves 22 and, upon rotation of cam ring 26, the cam arms will ride in cam slots 28 and open and close accordingly. Further details of this valve construction can be seen in the aforementioned copending application.

Some cartridge pumps, such as pump 12, are provided with means for draining the interior of the pump of residual fuel prior to removing the cartridge. To this end, a drain plug 32 is shown in FIG. 1 projecting radially outwardly from pump cartridge 12. The drain plug usually is threaded into or about a bore communicating through the pump housing to the interior cavity area of the pump to allow drainage of the residual fuel. Consequently, the drain plug is shown generally at the bottom of the cartridge to allow drainage by gravity.

As stated above, although precautionary measures are provided, such as automatic flap valves 22, to close the inlet to the pump before the pump cartridge is removed, problems still can be encountered should a malfunction in the closure system occur. In some instances, operators simply do not remove the drain plug, and the pump cartridge is removed with no knowledge whatsoever as to whether or not the pump inlet is completely sealed. This can cause major problems by massive leakage or flow of fuel from the tank in the event of valve malfunction. This invention is directed to solving such problems by providing means which prevent removal of the pump cartridge unless drain plug 32 has been removed. This not only facilitates but mandates a verification that the inlet valves have functioned properly and the tank is completely sealed.

More particularly, and still referring to FIG. 1, stop means, generally designated 34, are provided and located in the path of movement of the projecting drain means or plug 32 to prevent removal of pump cartridge 12 from housing 14 unless the drain plug itself is removed from the pump cartridge. In the illustrated embodiment of Figure 1, the pump cartridge is rotatably removable from the housing and, therefore, it can be seen that stop means 34 is located on housing 14 angularly disposed in the path of rotational movement of the drain plug during rotatable removal of the pump cartridge from the housing.

More particularly, FIGS. 2–4 show stop means 34 in greater detail. FIG. 2 shows drain plug 32 angularly disposed relative to stop means 34. In other words, when pump cartridge 12 is rotatably removed from housing 14 in the direction of arrow "A", the drain plug will abut into stop means 34 and the cartridge cannot be rotated any further until the drain plug is threadably removed from the cartridge. Should the inlet closure not be sealed, obviously a massive fuel leakage would come pouring out of the drain hole, rather than the minor residual fuel which the plug normally is intended to drain. Thus, automatic verification of the effectiveness of the inlet closure seal is provided.

Another feature of the invention is embodied in the specific construction of stop means 34 whereby the pump cartridge, with drain plug 32 already in place, can be easily and quickly reinstalled in housing 14 without repeating the tedious removal sequence in reverse. More particularly, stop means 34 is constructed with a base flange 36 secured to housing 14 by a pair of bolts 38. An axially projecting stop arm 40 is pivotally mounted to base flange 36 by a pivot bolt 42 extending through a pair of ears 44 (FIG. 4) integral with base flange 36. Base flange 36 is provided with a stop surface 46 and the inner end of stop arm 40 is provided with a stop surface 48. Therefore, it can be seen that movement of stop arm 40 in the direction of arrow "B" is restricted to the position shown in FIG. 3 by stop surfaces 46,48. On the other hand, stop arm 40 is provided with a rounded surface 50 to allow for the stop arm to freely rotate in a direction opposite that of arrow "B". In this manner, drain plug 32 will be stopped when rotating in the direction of arrow "A" (FIG. 2) which is the same direction as arrow "B" (FIG. 3). When the pump cartridge is reinstalled into the housing, the drain plug will simply engage the stop arm and freely move the stop arm in an installing direction in the opposite direction of arrow "B". The stop arm is spring loaded by a spring 54 which biases the stop arm to its fully extended or blocking position as shown in the drawings. Upon rotatably installing the pump cartridge, drain plug 32 simply moves stop arm 40 against the biasing of the spring.

FIG. 5 simply shows one configuration of a cam slot 56 and follower pin 58 for effecting a sequential movement of the various components in response to rotation of pump cartridge 12 relative to housing 14. Cam slot 56 is shown in FIG. 1 in the outside periphery of the pump cartridge, with cam follower pin 58 projecting inwardly from pump housing 14. During one portion of rotatable movement of the pump cartridge, as indicated by cam slot portion **56*a*, the pump cartridge simply rotates but does not move axially. During this degree of rotation (e.g. 30°), flap valves 22 are closed and drain plug 32 comes into stopped abutment with stop arm 40. At this point, the appropriate seals between the pump cartridge and the pump housing still are in engagement, but the cartridge cannot be moved any further because the drain plug is still in its closed position. The drain plug then is removed to drain residual fuel from the interior of the pump cartridge. If no massive flow of fuel occurs, verification thereby is made to the operator that the inlet valves are operative and have closed the inlet. The pump cartridge then is free to be further rotated, as indicated by cam slot portion 56b (FIG. 5) during which the pump cartridge moves both angularly and axially relative to the pump housing to break the seals therebetween. Once cam follower pin 58 reaches the position in cam slot 56 as shown in phantom in FIG. 5, the pump cartridge is free to be pulled axially completely out of the pump housing as cam follower pin 58 moves out of cam slot 56 through an axially extending open end 56c, in the direction of arrow "C". As stated above, this sequence of movements is repeated on reinstallation of the pump cartridge, but drain plug 32 can already be in place because the drain plug simply will overide the spring loaded stop arm 40**.

As stated above, the invention is equally applicable for rotatably or axially removable pump cartridges. FIGS. 1–5 have illustrated one embodiment of a rotatable cartridge. FIG. 6 simply shows in block diagram a pump cartridge 60 in a pump housing 62 whereby the pump cartridge can be axially removed in the direction of arrow "B". With such a construction, drain plug 32a again is shown at the bottom of the pump cartridge, but the stop means 34b is shown axially outwardly of the drain plug, i.e. in the axial path of movement thereof. Again, the stop means can be spring loaded so that the drain plug can be installed prior to reinstallation of the pump cartridge in the pump housing. This is shown to exemplify that the invention is applicable in a wide range of pump constructions, as long as the drain plug and stop means are located to prevent removal of the pump cartridge from the pump housing unless or until the drain plug is removed to verify that complete inlet closure has been effected.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a fuel pump for an aircraft fuel tank and the like, a fuel drain system comprising:

a housing;

a pump cartridge positionable in the housing for removal therefrom;

drain means removably mounted on and projecting from the pump cartridge for draining residual fuel from the pump cartridge prior to removal of the cartridge from the housing; and stop means located in a path of movement of the projecting drain means to prevent removal of the pump cartridge from the housing unless the drain means is removed from the pump cartridge.

2. The fuel drain system of claim 1 wherein said pump cartridge is, at least in part, relatively rotatably removable from the housing, and the stop means is located on the housing angularly disposed in the path of rotatable movement of the drain means during rotatable removal of the pump cartridge from the housing.

3. The fuel drain system of claim 1 wherein said stop means include means for blocking the drain means in a first removal direction of the pump cartridge from the housing but for allowing passage of the drain means in a second, installation direction of the pump cartridge in the housing.

4. The fuel drain system of claim 3 wherein said stop means is spring loaded.

5. The fuel drain system of claim 3 wherein said stop means include an arm pivotally mounted on and projecting from the housing for pivotal movement between a first, blocking position and a second, unblocking position.

6. The fuel drain system of claim 5 wherein said stop means is spring loaded to bias the arm to its blocking

7. In a fuel pump for an aircraft fuel tank and the like, a fuel drain system comprising:

a housing including an inlet;

closure means for opening and closing said inlet;

a pump cartridge positionable in the housing for removal therefrom;

means operatively associated between the pump cartridge in the closure means for closing the inlet in response to at least initial removal movement of the pump cartridge;

drain means removably mounted on and projecting from the pump cartridge for draining residual fuel from the pump cartridge prior to removal of the cartridge from the housing; and stop means located in a path of movement of the projecting drain means to prevent removal of the pump cartridge from the housing unless the drain means is removed from the pump cartridge, whereby removal of the drain means is effective to verify closing of the inlet by the closure means.

8. The fuel drain system of claim 7 wherein said pump cartridge is, at least in part, relatively rotatably removable from the housing, and the stop means is located on the housing angularly disposed in the path of rotatable movement of the drain means during rotatable removal of the pump cartridge from the housing.

9. The fuel drain system of claim 7 wherein said stop means include means for blocking the drain means in a first removal direction of the pump cartridge from the housing but for allowing passage of the drain means in a second, installation direction of the pump cartridge in the housing.

10. The fuel drain system of claim 9 wherein said stop means is spring loaded.

11. The fuel drain system of claim 9 wherein said stop means include an arm pivotally mounted on and projecting from the housing for pivotal movement between a first, blocking position and a second, unblocking position.

12. The fuel drain system of claim 11 wherein said stop means is spring loaded to bias the arm to its blocking position.

13. In a fuel pump which includes a housing, a pump cartridge positionable in the housing for removal therefrom, and drain means removably mounted on and projecting from the pump cartridge for draining residual fuel from the pump cartridge, the improvement comprising stop means located in a path of movement of the projecting drain means to prevent removal of the pump cartridge from the housing unless the drain means is removed from the pump cartridge.

14. The improvement of claim 13 wherein said stop means include means for blocking the drain means in a first, removal direction of the pump cartridge from the housing but for allowing passage of the drain means in a second, installation direction of the pump cartridge in the housing.

15. The improvement of claim 14 wherein said stop means is spring loaded.

16. The improvement claim 15 wherein said stop means include an arm pivotally mounted on and projecting from the housing for pivotal movement between a first, blocking position and a second, unblocking position.

17. The improvement of claim 16 wherein said stop means is spring loaded to bias the arm to its blocking position.

* * * * *